United States Patent [19]

Ingham

[11] Patent Number: 4,557,170

[45] Date of Patent: Dec. 10, 1985

[54] WORKPIECE SAW CUTOFF LENGTH MEASURING DEVICE

[76] Inventor: Gary G. Ingham, 737 N. Janeway, Moore, Okla. 73160

[21] Appl. No.: 602,288

[22] Filed: Apr. 20, 1984

[51] Int. Cl.[4] ..... B26D 7/16; B27B 27/10

[52] U.S. Cl. ..... 83/468; 83/471.2; 83/522

[58] Field of Search ..... 83/468, 522, 471.2; 30/371, 374, 388–391; 33/137–140, 185 R, 202; 269/315–320

[56] References Cited

U.S. PATENT DOCUMENTS 2,731,989 1/1956 Valcourt et al. ..... 33/138 X 2,745,447 5/1956 Studley, Jr. ..... 83/468 X 2,747,625 5/1956 Small ..... 33/138 X 3,807,269 4/1974 Mertes ..... 83/522 X

*Primary Examiner*—James M. Meister

*Attorney, Agent, or Firm*—Robert K. Rhea

[57] ABSTRACT

In a workpiece cutoff measuring device, in combination with a miter saw, or the like, a workpiece guide rail extends laterally from the plane of the saw and slidably supports a workpiece length measuring frame longitudinally slidably supported by the guide rail. The frame supports a conventional spring wound measuring tape case for indicating a desired dimension for cutting a workpiece to length and includes a tape clamp for maintaining the tape in a selected extended position.

2 Claims, 4 Drawing Figures

WORKPIECE SAW CUTOFF LENGTH MEASURING DEVICE

BACKGROUND OF THE INVENTION

1. Field of the Invention

The present invention relates to cutoff or miter saws and more particularly to a workpiece cutoff length measurement attachment for a power saw.

2. Description of the Prior Art

Prior patents disclosing workpiece cutoff length measuring guides as used with cutoff saws generally comprise indicia scored on a marginal edge portion of a workpiece table or support for indicating the length or distance to the workpiece end remote from the plane of the cutoff saw.

Other patents disclose flexible tapes secured at one end at the position of the saw with the other end portion of the tape moving in an extending or paying out action normal to the plane of the saw with the workpiece or to the end of the workpiece to measure the cutoff desired length.

This invention is distinctive over workpiece length cutoff measuring devices used in combination with a cutoff saw by providing a frame supporting a conventional spring wound flexible measuring tape and slidably supported by a workpiece guide rail extending laterally of the plane of the saw. One end of the tape is fixed to the saw structure so that lateral movement of the frame, relative to the saw along the workpiece guide rail, visually indicates a workpiece cutoff length between a workpiece stop and the saw blade.

SUMMARY OF THE INVENTION

An elongated generally box-like housing forms a frame having depending rails for forming an inverted U-shaped groove longitudinally slidably overlying the upper surface of a workpiece guide rail projecting laterally of the plane of a cutoff saw. One of the frame groove forming rails is movable toward and away from one side of the guide rail to accommodate different width guide rails and stabilize the measuring frame. A conventional metallic measuring tape is supported by the frame with one end of the tape extending from the frame to the position of the cutoff saw blade for indicating measurement increments from the frame to the workpiece cutoff position. A frame supported tape clamp locks the tape in a selected extended position. A workpiece stop, attached to and movable with the frame, insures an accurate cutoff length of a workpiece for cutting one or a plurality of workpieces to an identical length.

The principal object of this invention is to provide a workpiece cutoff length measuring device easily mounted on the workpiece guide rail of a cutoff saw which utilizes a flexible rule and includes a workpiece cutoff length stop easily adjusted for different length workpieces or maintained in a fixed position for cutting a plurality of workpieces to the same length.

DESCRIPTION OF THE PREFERRED EMBODIMENT

Figure 1:
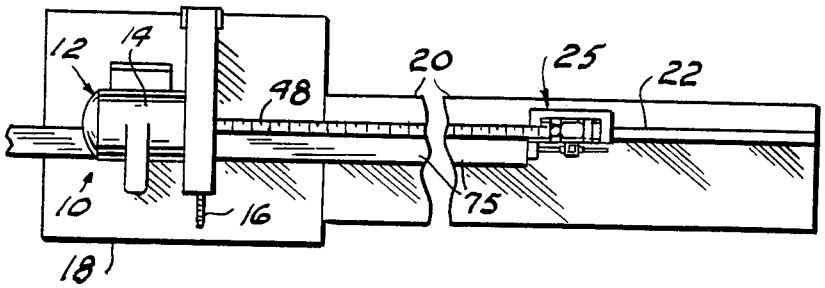
FIG. 1 is a fragmentary top view of a cutoff saw having the measurement device connected thereto.
Figure 2:
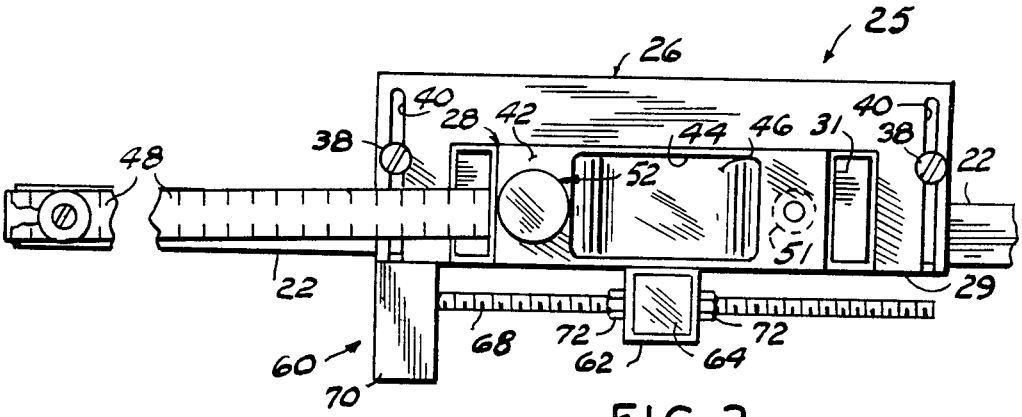
FIG. 2 is a fragmentary top view, to a larger scale, of the tape supporting frame.
Figure 4:
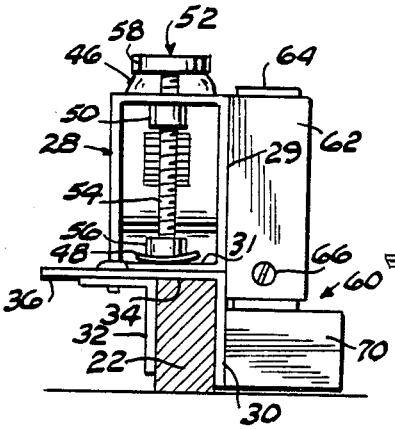
FIG. 4 is a left end elevational view of FIG. 3, partially in section.
Figure 3:
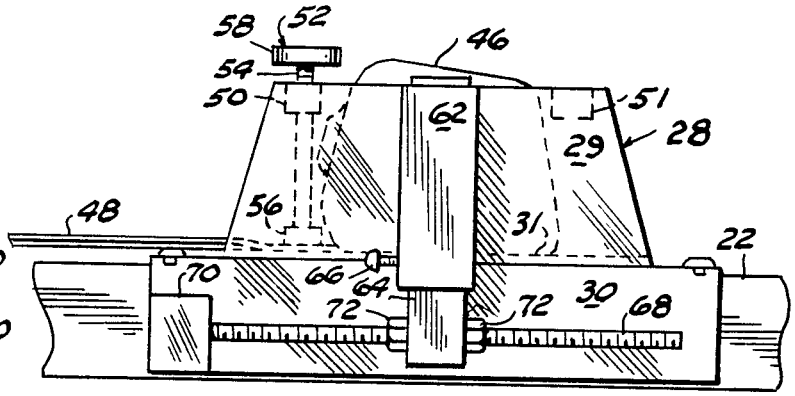
FIG. 3 is a side elevational view of FIG. 2.

Like characters of reference designate like parts in those figures of the drawings in which they occur.

In the drawings:

The reference numeral 10 diagrammatically illustrates a workpiece cutoff saw 12 including a saw motor 14 having a circular blade 16 mounted thereon and movable with the saw motor toward and away from the surface of a horizontal base or platform 18 supporting the saw 12, the saw 12 being any type in which the saw blade is moved toward the workpiece, such as a miter saw or a radial saw.

The above description is conventional with many workpiece cutoff saws and is set forth to show the combination with which the workpiece length measuring device is used.

The numeral 20 indicates a work table horizontal extension of the base or platform 18 projecting normal to the plane of the saw blade 16 and longitudinally supporting a workpiece fence or guide rail 22. The guide rail 22 may be of any desired shape in transverse section and is rectangular in the example shown.

The workpiece measuring device 25 comprises a tape measure case support frame 26, hereinafter referred to as "frame 26", which overlies, in longitudinally slidable relation, a portion of the workpiece guide rail 22. The frame 26 is formed by an open end short length of box channel material 28 longitudinally overlying the guide rail 22 with one of its vertical side walls 29 in the plane of and attached to a depending rail 30 disposed adjacent the workpiece contacting side of the guide rail 22 and having a width greater than the box channel and a length extending longitudinally beyond the respective ends of the box channel 28. The box channel bottom wall 31 flatly overlies a plate 36 integral with the rail 30 and flatly overlying the top surface of the guide rail 22. An angle member, forming a second rail 32, contacts the opposite side of the guide rail 22 to form an inverted U-shaped groove 34 longitudinally slidably nesting an intermediate portion of the guide rail 22. The rail 32 is adjustably secured to the plate 36 adjacent the respective ends of the box channel 28 by screws 38 slidably disposed in slots 40, formed in the plate 36, and extending transversely of the longitudinal axis of the guide rail 22. The screws 38 thus permit lateral adjustment of the spacing between the rails 30 and 32 to compensate for different width workpiece guide rails and insures free sliding movement of the frame 26 relative to the guide rail 22.

The box channel top wall 42 is apertured, as at 44, for inserting a tape case 46 containing a spring wound metallic flexible rule or tape 48 having indicia indicating increments of measurement thereon whereby the free or beginning end of the tape 48 may be suitably anchored or fixed to the guide rail 22 or other structure of the saw 12 adjacent the plane of the saw blade 16 so that the spacing between the saw blade and the position of the frame 26 is readily visible by the indicia on the tape at a selected position on the frame. Manually moving the frame 26 along the guide rail toward or away from the position of the saw blade 16 winds up or pays out the tape 48. The tape case 46 is maintained within the box channel 38 against longitudinal movement of the tape case relative to the box channel by a pair of centrally bored and threaded bosses 50 and 51 depending from the box channel top wall 42 adjacent the respective open end of the box channel. A desired precise length for the workpiece cut, as indicated by the indicia on the tape 48, is obtained by a tape clamp 52 including an externally screw threaded shank 54 entering the boss 50 and provided with a foot portion 56 impinging the tape against the upper surface of the box channel bottom wall 31. A manually rotatable knob 58, on the opposite end of the shank 54, facilitates tape clamping and unclamping action of the tape clamp 52.

Workpiece stop means 60 is secured to the frame depending rail 30 on its side opposite the angle member 32. The stop means 60 may be rigidly secured to the frame 26, if desired, but in the example shown, is adjustably and reversibly secured to the frame. The stop means 60 comprises a vertical tube 62 having a length at least coextensive with the height of the box channel side wall 29 and is secured thereto medially its length.

A mandrel 64 is slidably received by the tube 62 and is held therein by a set screw 66. The depending end portion of the mandrel projects downwardly beyond the tube 62 and is transversely bored parallel with the longitudinal axis of the guide rail 22 for receiving an intermediate portion of a stop screw 68 having a workpiece stop 70 secured to one of its ends. The workpiece stop 70 is maintained in a selected position relative to the frame 26 by lock nuts 72 on opposite sides of the mandrel 64. The purpose of mounting the stop 70 on the mandrel 64 is so that the stop may be moved toward and away from the surface of the platform 20 to insure engagement with relatively thin workpiece material and to permit the stop 70 to be reversed, ie, disposed at the opposite end of the frame 26. Similarly, the tape case holding threaded boss 51 permits moving the clamp 52 and reversing the frame 26 for mounting it on a workpiece guide rail extending from the plane of the saw blade 16 opposite the position shown of the guide rail 22 as shown by FIG. 1.

OPERATION

In operation, the device, assembled as described hereinabove, is positioned on the workpiece guide rail 22. The workpiece stop 70 is adjusted relative to the frame 26 so that it is transversely aligned with an edge surface of the frame facing the saw blade so that when the tape 48 is extended or retracted, as by moving the frame 26, a selected indicia of measurement is aligned with the selected surface of the frame and the surface of the stop facing the saw blade. Obviously, a tape measurement position mark, not shown, may be scored or painted on the top surface of the plate portion 36 for alignment with tape indicia and coinciding with the workpiece contacting surface of the stop 70. In either event, the distance or measurement indicated by the tape 48 registers and visually indicates the spacing between the stop 70 and adjacent surface of the saw blade 16 and thus the desired length of a workpiece 75.

The mass of the frame 26 and coefficient of sliding friction temporarily maintains the frame 26 in a selected tape extended position until the tape clamp 52 is operated.

Obviously the invention is susceptible to changes or alterations without defeating its practicability. Therefore, I do not wish to be confined to the preferred embodiment shown in the drawings and described herein.

I claim:

1. A workpiece cutoff length measurement indicator in combination with a workpiece supporting horizontal saw platform and a saw including a blade adapted for movement in a vertical plane toward and away from a workpiece on the platform, the improvement comprising:

a workpiece guide rail secured to said platform and extending laterally from the plane of the saw blade and having an upper surface and a workpiece aligning face;

a flexible measuring tape;

a channel member longitudinally overlying the upper surface of said guide rail and surrounding the tape case;

frame rails depending from said channel member for slidably contacting opposing sides of said guide rail during movement of said frame means;

measuring tape supporting frame means including a workpiece end engaging stop transversely overlying the workpiece guide rail in longitudinal sliding relation for visually indicating the distance between said frame means and the adjacent surface of the saw blade, said workpiece stop including, a stop disposed laterally of the frame means adjacent the guide rail workpiece aligning face, and, stop support means adjustably connecting said stop with the frame means for adjusting the position of the stop relative to the length of the channel member; and, tape clamp means supported by said channel member for preventing movement of said frame means relative to the paid out or wound up position of the tape.

2. The combination according to claim 1 in which the stop support means includes:

mandrel and tube means vertically adjustably secured to the workpiece stop equipped side of said channel member; and, a stop screw secured at one end to said stop and longitudinally adjustably connected with one end of the mandrel.

* * * * *